US006182323B1

(12) United States Patent
Bahten

(10) Patent No.: US 6,182,323 B1
(45) Date of Patent: Feb. 6, 2001

(54) ULTRACLEAN SURFACE TREATMENT DEVICE

(75) Inventor: Kristan G. Bahten, Gold River, CA (US)

(73) Assignee: Rippey Corporation, El Dorado Hills, CA (US)

( * ) Notice: Under 35 U.S.C. 154(b), the term of this patent shall be extended for 0 days.

(21) Appl. No.: 09/192,878

(22) Filed: Nov. 16, 1998

Related U.S. Application Data

(60) Provisional application No. 60/079,767, filed on Mar. 27, 1998.

(51) Int. Cl.[7] ..... B05C 1/00; B05C 17/00; A47L 17/00

(52) U.S. Cl. ..... 15/230.16; 15/230; 15/244.4; 134/22.1; 134/22.17; 428/131

(58) Field of Search ..... 134/22.1, 22.17, 134/22.19; 15/102, 97.1, 230, 230.16, 244.1, 244.4; 428/131, 119

(56) References Cited

U.S. PATENT DOCUMENTS 4,795,497 1/1989 McConnell et al. ..... 134/18
5,639,311 * 6/1997 Holley et al. ..... 134/6
5,693,148 * 12/1997 Simmons et al. ..... 134/18
5,853,522 * 12/1998 Krusell et al. ..... 156/345
5,868,863 2/1999 Hymes et al. ..... 134/28
5,979,740 * 11/1999 Cercone et al. ..... 134/22.12
6,004,402 * 12/1999 Cercone et al. ..... 134/2
6,027,573 * 2/2000 Cercone et al. ..... 134/28

* cited by examiner

*Primary Examiner*—Randy Gulakowski
*Assistant Examiner*—Shamim Ahmed
(74) *Attorney, Agent, or Firm*—Townsend and Townsend and Crew LLP

(57) ABSTRACT

The present invention provides a novel porous polymeric device (101) (103) (105) (107) (109) (111) (113), e.g., an ultraclean brush. The device includes an elongated foam member (101, 103), which has an outer surface for removing residual particles from a surface of a substrate. Among other features, the elongated foam member includes a polyvinyl alcohol bearing compound, where the elongated foam member has a calcium ion impurity concentration of less than about 1 part per million. Accordingly, the present device is much cleaner than conventional devices.

20 Claims, 5 Drawing Sheets

ULTRACLEAN SURFACE TREATMENT DEVICE

CROSS-REFERENCE TO RELATED APPLICATIONS

This present application claims priority to U.S. Ser. No. 60/079,767 filed Mar. 27, 1998, commonly assigned, and hereby incorporated by reference for all purposes. This present application is related to U.S. Ser. Nos. 60/079,753 and 60/079,661, commonly assigned, and hereby incorporated by reference for all purposes. The application is also related to U.S. Ser. Nos. 09/193,009 and 09/193,054 filed on the same date as the present application, commonly assigned, and hereby incorporated by reference for all purposes.

BACKGROUND OF THE INVENTION

The present invention relates to the manufacture of objects. More particularly, the present invention provides a technique including a system for manufacturing an ultraclean "scrubbing" brush or surface treatment device for the manufacture of integrated circuits, for example. Merely by way of example, the present invention is applied to a scrubbing device for the manufacture of integrated circuits. But it will be recognized that the invention has a wider range of applicability; it can also be applied to the manufacture of semiconductor substrates, hard disks, flat panel displays, and the like.

In the manufacture of electronic devices such as integrated circuits, the presence of particulate contamination, trace metals, and mobile ions on a wafer is a serious problem. Particulate contamination can cause a wide variety of problems such as electrical "opens" or "shorts" in the integrated circuit. These opens and shorts often lead to reliability and functional problems in the integrated circuit that has the opens or shorts. Mobile ion and trace metal contaminants can also lead to reliability and functional problems in the integrated circuit. The combination of these factors is the main source of lower device yields on a wafer, thereby increasing the cost of an average functional device on the wafer. In the manufacture of highly integrated devices, planarizing techniques have been used.

Chemical-mechanical polishing ("CMP") is a commonly used technique for planarizing a film on the wafer prior to subsequent processing of the wafer. CMP often requires an introduction of a polishing slurry onto a surface of a film on the semiconductor wafer as the wafer is being mechanically polished against a rotating polishing pad. The slurries typically are water based and can contain fine abrasive particles such as silica, alumina, and other abrasive materials. After polishing is complete, the processed wafers must be cleaned to completely remove residual slurry and other residue from the polishing process in order that the surface is ready for other processing steps such as etching, photolithography, and others.

To clean residual slurry material from the surface of the polished surface, cleaning brushes have been used. These cleaning brushes are often a member that is cylindrical in shape, which generally rotates along a center axis of the cylindrical shaped member. The cleaning brushes are also often made of a foam or porous polymeric material such as polyvinyl alcohol ("PVA"). A combination of rotational movement of the brush and force or pressure placed on the brush against the wafer causes residual slurry materials to be removed from the surface of the wafer. Unfortunately, it has been found that the brushes themselves often contain residual materials from the brush manufacturing process. These residual materials include, among others, residual particles and impurities such as ions and particulate contamination. Given that brushes are often "dirty" from a manufacturer, it is often difficult to maintain cleanliness of an integrated circuit manufacturing process by using such dirty brushes.

From the above, it is seen that an improved technique for cleaning a surface treatment device is highly desired.

SUMMARY OF THE INVENTION

According to the present invention, a technique including a treatment device for cleaning surfaces is provided. In an exemplary embodiment, the present invention provides an ultraclean or microclean surface treatment device which includes a scrubbing brush for the manufacture of substrates for the electronics industry.

In a specific embodiment, the present invention provides a novel porous polymeric device, e.g., an ultraclean brush. The device includes an elongated porous polymeric member, which has an outer surface for removing residual particles from a surface of a substrate. Among other features, the member includes a polyvinyl alcohol bearing compound, where the elongated member has a calcium ion impurity concentration of less than about 1 part per million. Accordingly, the present device is much cleaner than conventional devices.

In an alternative embodiment, the present invention provides a surface treatment device. The device is a porous polymeric member including an outer surface for removing residual particles from a surface of a substrate such as a wafer or hard disk. The porous polymeric member is made of at least a polyvinyl alcohol bearing compound, which may be known as PVA, but is not limited. The porous polymeric member also has a calcium ion impurity concentration of less than about 1 part per million, and a sodium ion concentration of less than about 0.1 part per million. The porous polymeric member is substantially free from loose portions (e.g., un-cross-linked) of the porous polymeric member greater than about 1 micron in size, or greater than about 0.5 micron in size, or greater than about 0.1 micron in size.

Numerous advantages are achieved using the present invention over conventional techniques. For example, the present invention provides an ultraclean or microclean brush product in some embodiments. The present brush product is cleaner and tends to introduce fewer particles or impurities onto a substrate to be processed. Additionally, the present brush product is cleaner "out of the box." That is, the present brush product is much cleaner on delivery than conventional products, which are now on the market at the filing date of this present application. Accordingly, the present brush product is easier to use and provides for a more efficient manufacturing process, which is important in the manufacture of integrated circuits, for example. The present invention can also be applied to other porous polymeric products. These and other advantages or benefits are described throughout the present specification and are described more particularly below.

These and other embodiments of the present invention, as well as its advantages and features are described in more detail in conjunction with the text below and attached Figs.

DESCRIPTION OF SPECIFIC EMBODIMENTS

Figure 1A:
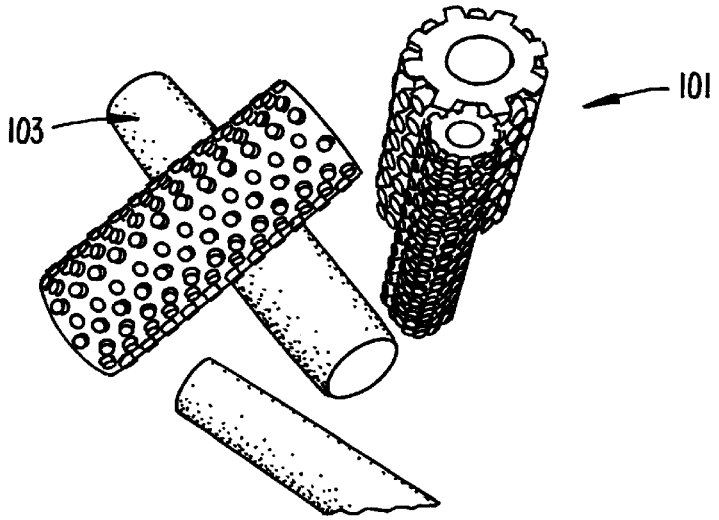
FIG. 1 is a simplified diagram of surface treatment devices according to embodiments of the present invention.
Figure 1B:
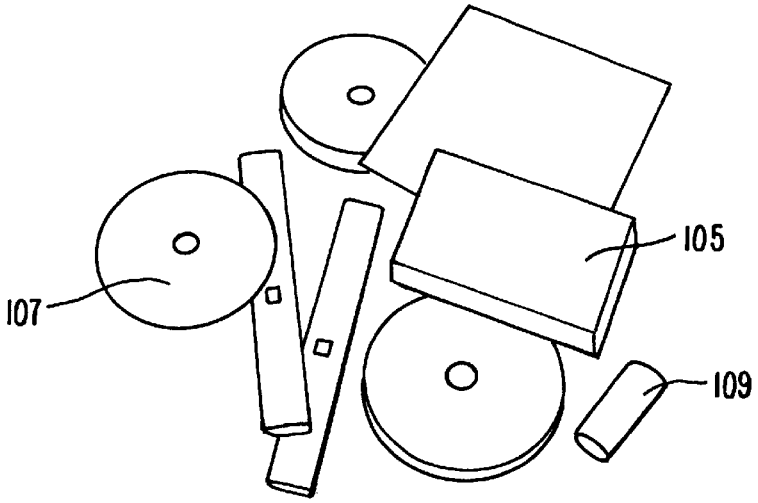
Figure 1C:
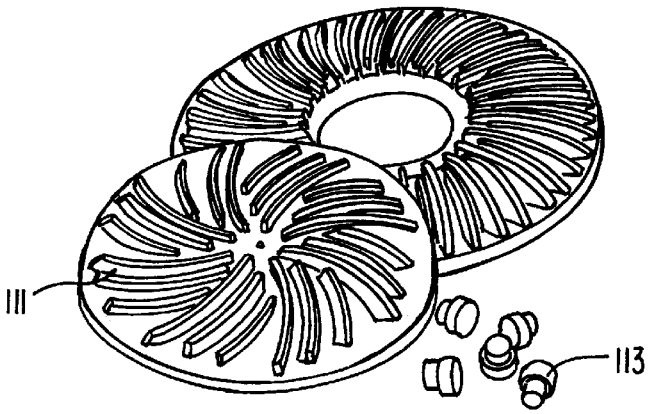

FIG. 1 is a simplified diagram of surface treatment devices according to embodiments of the present invention. This Fig. is merely an illustration and should not limit the scope of the claims herein. One of ordinary skill in the art would recognize other variations, modifications, and alternatives. As shown, the devices or porous polymeric products (e.g., foam or sponge products) can range in size and shape, depending upon the application. According to an embodiment, the device can be shaped as brush rollers 101, which have protrusions thereon, or brush rollers 103 that have smooth surfaces. These brush rollers have shapes and sizes to meet the particular cleaning application for devices such as semiconductor wafers, hard disks, and other applications. The device can also be in the form of wipes 105, disks 107, and custom applications 109. Additionally, the device can be in the form of puck brushes 111 and plugs 113. Furthermore, the device can be in other shapes and sizes depending upon the application.

In a specific embodiment, the devices are made using a suitable material that is firm, porous, elastic, and has certain abrasion resistiveness. In most embodiments, the main raw starting material for the device is polyvinyl alcohol, but can be others. As merely an example, polyvinyl alcohol is used to form a polyvinyl acetal porous elastic material. The porous material varies in characteristic depending upon cleanliness, type of pore forming agent or process, type of aldehyde employed for the conversion of a polyvinyl alcohol to a polyvinyl acetal, and other factors. These factors also include the relative proportions of reactants, reaction temperature and time, and the general condition and starting materials in the manufacturing process. Cleanliness of the manufacturing process is also important in the manufacture of these devices.

Cleaning effectiveness of the device also depends upon a porosity and pore size of the device. In most embodiments, the porosity can be more than about 85%. In devices where porosity is less than 85% polyvinyl acetal porous elastic material may have poor flexibility. In most embodiments, the porosity is less than about 95%, since a greater porosity value may provide poor strength. Other characteristics include a desirable average pore size or opening. The pore size opening in some embodiments ranges from about 10 micron to about 200 micron. In devices where the average pore opening is less than 10 micron, the porous elastic material may have poor elasticity and/or flow properties, thus making the performance of the cleaning roll unsatisfactory. Alternatively, the average pore opening of more than 200 microns can be unsuitable for a cleaning roll because of inconsistent pore configuration. Of course, the selected pore size and porosity depend upon the application.

The polyvinyl acetal porous elastic material usable for the present invention can be produced in a known manner, for example, by dissolving at least one polyvinyl alcohol having an average degree of polymerization of 300 to 3,000 and a degree of saponification of not less than 80% in water to form a 5% to 30% aqueous solution, adding a pore forming agent to the solution, and subjecting the solution to reaction with an aldehyde such as formaldehyde or acetaldehyde until the device becomes water-insoluble. The polymer is 50 to 70 mole % of acetal units. In some embodiments, where the polymer has less than 50 mole % of acetal units, the retained polyvinyl alcohol may ooze out from the product upon use and undesirably contaminate the article to be cleaned. Where the polymer has more than 70 mole % of acetal units, the device may have poor elasticity and flexibility in other embodiments.

Although the above devices are generally described in selected shapes and sizes, alternative configurations can also be used. As merely an example, the polymeric product can have a gear-like configuration, which has numerous parallel grooves formed at an angle to the roll. Additionally, protrusions or projections on the surface of the foam product can include a variety of shapes, e.g., circular, ellipsoidal, rectangular, diamond, or the like. The total surface area occupied by the projections can range in value from about 10% and greater, or about 15% to 65%, or greater than about 65%. Of course, the particular shape and size of the foam product depends upon the application.

Other techniques can also be used to manufacture porous polymeric devices used for surface treatment applications. These techniques include, among others, an air injected foam or sponge product as well as others. The device can also be made of polyurethane, and others.

The present devices have fewer impurities and/or particulates than conventional foam products. In a preferred embodiment, the concentration ranges of the impurities are shown in, for example, Table 1A. These impurity concentrations compare a conventional brush with the present brush. Concentrations are noted in parts per million and were derived using ion chromatography or ICPMS.

TABLE 1A

Impurity Levels in Present Foam Product

| Impurity | Conventional Brush (PPM) | Present Brush (PPM) |
|---|---|---|
| Fluoride | 13.0 | <.1 |
| Chloride | 5.0 | <1.0 |
| Nitrite | <0.5 | <0.01 |
| Bromide | <1.0 | <0.05 |
| Nitrate | <1.0 | <0.05 |
| Phosphate | <1.0 | <0.05 |
| Sulfate | 9.5 | <0.20 |
| Lithium | <0.1 | <0.1 |
| Calcium | 7.3 | <0.05 |
| Magnesium | 3.2 | <0.01 |
| Potassium | 2.33 | <0.05 |
| Sodium | 243 | <0.10 |

Based upon Table 1A, it is clear that the present invention provides a much cleaner device that conventional ones. In particular, the concentration of sodium, for example, which is detrimental to integrated circuits, is less than about 0.10 parts per million ("PPM") from a conventional value of about 243 PPM. Additionally, the other impurities also have been substantially reduced by way of the present invention.

In an alternative embodiment, the present devices would have fewer impurities and/or particulates than conventional foam products. In this embodiment, the concentration ranges of the impurities are shown in, for example, Table 1B. These impurity concentrations compare a conventional brush with the present brush. Concentrations are noted in parts per million and were derived using ICPMS.

TABLE 1B

Impurity Levels in Present Foam Product

| Impurity | Standard Brush (PPM) | Present Brush (PPM) |
|---|---|---|
| Aluminum | 0.116 | <0.01 |
| Barium | 0.0032 | <0.01 |
| Beryllium | Not detected | <0.004 |
| Bismuth | Not detected | <0.004 |
| Boron | 0.0407 | <0.01 |
| Cadmium | Not detected | <0.003 |
| Calcium | 7.3 | <0.1 |
| Cesium | Not detected | <0.002 |
| Chromium | 0.0165 | <0.01 |
| Cobalt | 0.0004 | <0.0002 |
| Copper | 0.0553 | <0.01 |
| Gallium | Not detected | <0.0004 |
| Indium | Not detected | <0.0002 |
| Iron | 0.32 | <0.1 |
| Lead | 0.0184 | <0.01 |
| Lithium | 0.001 | <0.0003 |
| Magnesium | 3.2 | <0.1 |
| Manganese | Not detected | <0.0005 |
| Molybdenum | Not detected | <0.0005 |
| Nickel | Not detected | <0.0005 |
| Potassium | 2.33 | <0.1 |
| Rubidium | Not detected | <0.0001 |
| Silicon | 12 | <1 |
| Silver | Not detected | <0.0003 |
| Sodium | 242 | <10.0 |
| Strontium | 0.0359 | <0.0001 |
| Thallium | Not detectable | <0.0005 |
| Thorium | Not detected | <0.0002 |
| Tin | 0.0107 | <0.0017 |
| Titanium | 0.0048 | <0.0005 |
| Tungsten | Not detected | <0.0002 |
| Vanadium | Not detected | <0.008 |
| Zinc | 0.064 | <0.02 |

Table 1B: Impurity Levels in Present Foam Product

Based upon Table 1B, it is clear that the present invention provides a cleaner device that conventional ones. In particular, the concentration of calcium, for example, which is detrimental to integrated circuits, is less than about 0.10 parts per million ("PPM") from a conventional value of about 7.3 PPM. Additionally, the other impurities also have been substantially reduced by way of the present invention. The present invention achieves these results by way of a novel cleaning procedure, which is described below in more detail.

Figure 2:
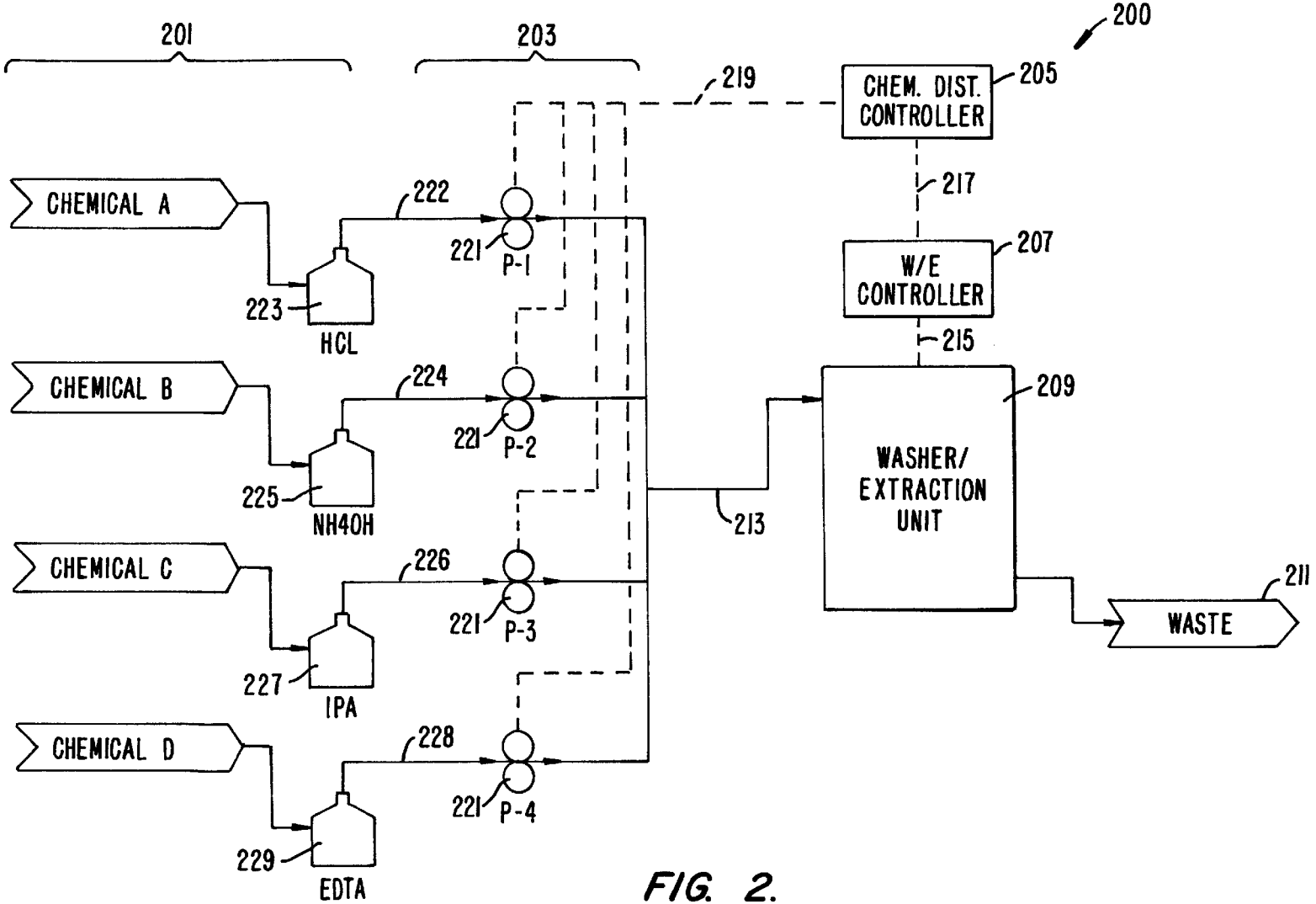
FIG. 2 is a simplified diagram of a cleaning system according to an embodiment of the present invention.

FIG. 2 is a simplified diagram of a cleaning system 200 according to an embodiment of the present invention. This Fig. is merely an illustration and should not limit the scope of the claims herein. One of ordinary skill in the art would recognize other variations, modifications, and alternatives. The simplified diagram shows a system 200, used to clean porous polymeric products (e.g., foam, sponge) to microclean or ultraclean levels. System 200 includes a variety of features such as a chemical source region 201, and a chemical metering region 203. A variety of chemicals used for cleaning are available in the chemical source region 201. These chemicals include, among others, acids, bases, solvents, and chelating agents. The chemicals preferably include hydrochloric acid (HCl) 223, ammonium hydroxide ($NH_4OH$) 225, isopropyl alcohol (IPA) 227, and ethylenediaminetetraacetic acid (EDTA) 229, but are not limited to these. Each of these chemical sources is coupled to a metering pump 221 through one of a plurality of lines 222, 224, 226, and 228. Line 222 connects metering pump 221 (P-1) to the HCl source, line 224 connects metering pump 221 (P-2) to the $NH_4OH$ source, line 226 connects metering pump 221 (P-3) to the IPA source, and line 228 connects metering pump 221 (P-4) to the EDTA source. All of these lines combine at a manifold, which directs the chemical or fluid to line 213, which connects to the washer/extraction unit 209. In other embodiments, the lines may be kept apart to be separate from each other.

The chemical source region is made of a suitable enclosure for preventing chemicals from escaping into the environment or plant floor. In some embodiments, the source region is made by a chemically non-reactive material such as polypropylene, Kynar™, Teflon™, polyvinyl chloride, or others. In most embodiments, the source region is double contained. That is, chemicals escaping from any of the sources are trapped and drain out of the source region without escaping to the plant floor or environment. In other embodiments, the chemical source region is triple contained. Of course, the type of source unit used depends upon the nature and types of chemicals.

Pumps (P-1, P-2, P-3, P-4) are commonly controlled by a chemical distribution controller 205, which is electrically connected by line 219. Line 219 separates into a plurality of lines to control each of the pumps for metering purposes. As merely an example, the metering pumps are capable of handling a wide variety of corrosive chemicals and solvents. These pumps are often units made by a company called Nova Systems, but can be others.

Chemical distribution controller 205 communicates to the pumps through line 219 that separates into independent lines to metering pumps. Chemical distribution controller 205 can be any suitable unit for metering chemicals from one of a plurality of chemical sources through one of a plurality of metering pumps. Alternatively, multiple pumps can be actuating to bring in more than one chemical source into the washer/extraction unit. The controller has input/output modules, which receive and transmit signals to and from selected system elements. The controller is sufficiently chemical resistant and is durable for manufacturing operations. As merely an example, the controller is a product called Novalink, which is made by a company called Nova Systems. Of course, other controllers can also be used.

To oversee the operation of the system including the washer/extraction unit, a washer/extraction unit controller 207 couples to controller 205 through line 217, and couples to washer/extraction unit 209 through line 215. The controller has a variety of input and output modules. These modules are used to interface with sensors, motors, pumps, and the like from the washer/extraction unit, as well as other apparatus or devices. The controller is a microprocessor based unit which is coupled to memory, including dynamic random access memory, and program storage devices. A variety of process recipes can be stored in memory of the controller. The controller is also sufficiently chemical resistant and is durable for manufacturing operations. As merely an example, the controller from the Dubix machine. Of course, other controllers can also be used.

Also shown is a waste stream 211 from the washer/extraction unit. The waste stream removes used fluids or undesirable fluids from the washer extraction unit. In preferred embodiments, the waste fluid stream is chemically balanced and is safe to health, environment, and property. In some embodiments, washer/extraction unit uses a specific process recipe that produces an environmentally safe waste stream. Alternatively, the waste stream must be treated before returning fluids back to the environment. Preferably, the waste stream is balanced or pH balanced to meet environmental specifications.

The washer/extraction unit is used with a variety of process recipes to clean and remove impurities from the foam product or products. The unit can be any suitable washing machine-type unit with a variety of cleaning and rinsing cycles, which are programmable. As merely an example, the unit is a product made by a company known as Dubix, but can be others. The unit is made of a suitable material to be chemically resistant and clean to reduce any possibility of particulate contamination or the introduction of impurities onto the foam products. In preferred embodiments, the unit is a spin/rinse unit, which rotates a basket in a circular manner, to clean and remove impurities from the foam product. The spin/rinse unit is preferably made of stainless steel or another relatively non-reactive material that does not introduce impurities into the porous polymeric product.

In an alternative embodiment, the present invention provides a ware washing machine according to an embodiment of the present invention. The ware washing machine can be in the form of commercial dish washing machines and the like, which are to be used to carry out the techniques of the present invention. Among ware washing machines, the present invention uses door loading and/or conveyor type machines. Door loading machines operate on a "batch" basis in which articles (e.g., porous polymeric or sponge products) are loaded into the machine, the articles are placed through various cycles such as wash, rinse, and others. After completing the cycles, the articles are removed. In conveyor type machines, for example, the articles including the sponge or porous polymeric products are placed in one end of the machine, passed through the device, and subjected to various operations based on their location in the device. The ware washing machine can use any suitable control systems. These control systems base chemical charge on the article based upon timing. For example, certain control systems have often dispensed chemicals when the article is in a rinse cycle.

Although the above is generally described in terms of a washer/extraction unit, the present system can also include other types of washing and/or rinsing units. These units can be a batch-type unit, which include a plurality of washing and rinsing tanks. Alternatively, the units can include sprayers, misters, atomizers, sonic generators, and the like. The system should have sufficient mechanical forces to remove liquid from the products in an efficient manner. The system also should be able to fully displace the products if desired. Of course, the type of unit used depends upon the application.

A process according to the present invention can be briefly outlined as follows:

(1) Provide products from manufacturer;

(2) Insert products into washer;

(3) Perform pre-wash with clean water;

(4) Perform solvent wash;

(5) Perform acid wash;

(6) Perform caustic wash;

(7) Perform chelation wash;

(8) Perform rinse;

(9) Spin extract;

(10) Perform additional steps, as required; and

(11) Remove cleaned products.

Figure 3:
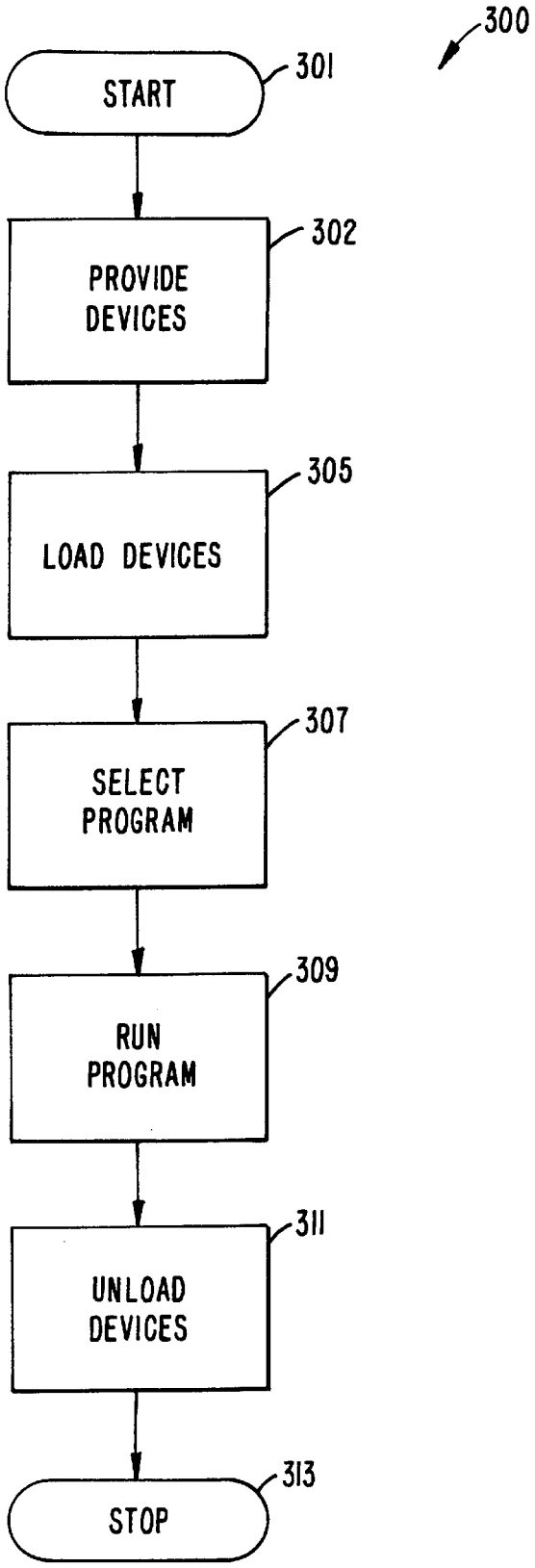
FIGS. 3 and 3A are simplified flow diagrams of cleaning methods according to embodiments of the present invention.

The above sequence of steps are used to substantially remove all particulate contamination and impurities from the porous polymeric devices. These devices are often "dirty" from the manufacturing process and should be substantially cleaned before use in a manufacturing operation, e.g., semiconductor fabrication. The above sequence of steps removes or substantially reduces quantities of ionic contamination, trace metals, particulates, and other forms of contamination. Although complex, the above sequence of steps is easily used in a washer unit with a programmable control unit. Depending upon the embodiment or embodiments, a rinse cycle or cycles may follow any of the above washes. Accordingly, the present method can be easily implemented using conventional technology in a cost effective manner. Details of the above method are illustrated by way of FIG. 3, which illustrates a simplified flow diagram 300 of a cleaning method according to an embodiment of the present invention. This Fig. is merely an illustration and should not limit the scope of the claims herein. One of ordinary skill in the art would recognize other variations, modifications, and alternatives.

As merely an example, a process according to the present invention begins at step 301. The process has a step (step 302) of providing a plurality of porous polymeric devices, which require cleaning. These devices are generally from a manufacturer of polymeric devices or foam products. An example of this device is a product made by a company called Kanebo Limited of Japan. Other companies also have similar devices. These companies include, among others, Cupps Industrial Inc., Merocel Scientific Products, Perfect and Glory Enterprise Co., Ltd. In generally all of the present embodiments, the polymeric devices include a variety of impurities that can be detrimental to the manufacture of integrated circuits, for example. These impurities should be removed or reduced in concentration before use in a clean or sensitive environment.

The devices are loaded (step 305) into a washer/extraction unit which can be programmed with a variety of process recipes to clean and remove impurities from the devices. The unit can be any suitable washing machine-type unit with a variety of cleaning and rinsing cycles, which are programmable. As merely an example, the unit is a product made by a company called Dubix, but can be others. The unit is made of a suitable material to be chemically resistant and clean to reduce any possibility of particulate contamination or the introduction of impurities onto the devices to be cleaned. In preferred embodiments, the unit is a spin/rinse unit, which rotates a basket in a circular manner, to clean and remove impurities from the devices. The rotational action provides mechanical agitation to fluids that tend to loosen and remove impurities and particulate from the devices.

A program according to this embodiment is selected from the washer/extraction unit. The program is often loaded into controller such as a unit made by a company called Nova, as well as others. This program can carry out a variety of cleaning processes. This program removes a substantial amount of impurities and particulate contamination from the devices. After the process, the devices are substantially free from impurities. As merely an example the impurities would be less than those noted in Table 1, but can be others depending upon the application and needs. The cleaned or microcleaned devices are removed (step 311) from the washer/extraction unit in a clean room environment before packaging. The clean room environment is generally at least a Class 100 or Class 10 clean room, which prevents additional contamination from attaching onto the devices. The process stops at step 313, but additional steps can be performed as desired.

A process according to an alternative embodiment of the present invention can be briefly outlined as follows:

(1) Provide products from manufacturer;

(2) Insert products into washer;

(3) Perform pre-wash with clean water;

(4) Perform solvent wash;

(5) Rinse solvent wash;

(6) Perform first acid wash;

(7) Perform second acid wash;

(8) Rinse acid washes;

(9) Perform first caustic wash;

(10) Perform EDTA wash;

(11) Perform second caustic wash;

(12) Rinse caustic washes;

(13) Spin extract;

(14) Perform additional steps, as required; and

(15) Remove cleaned products.

Figure 3A:
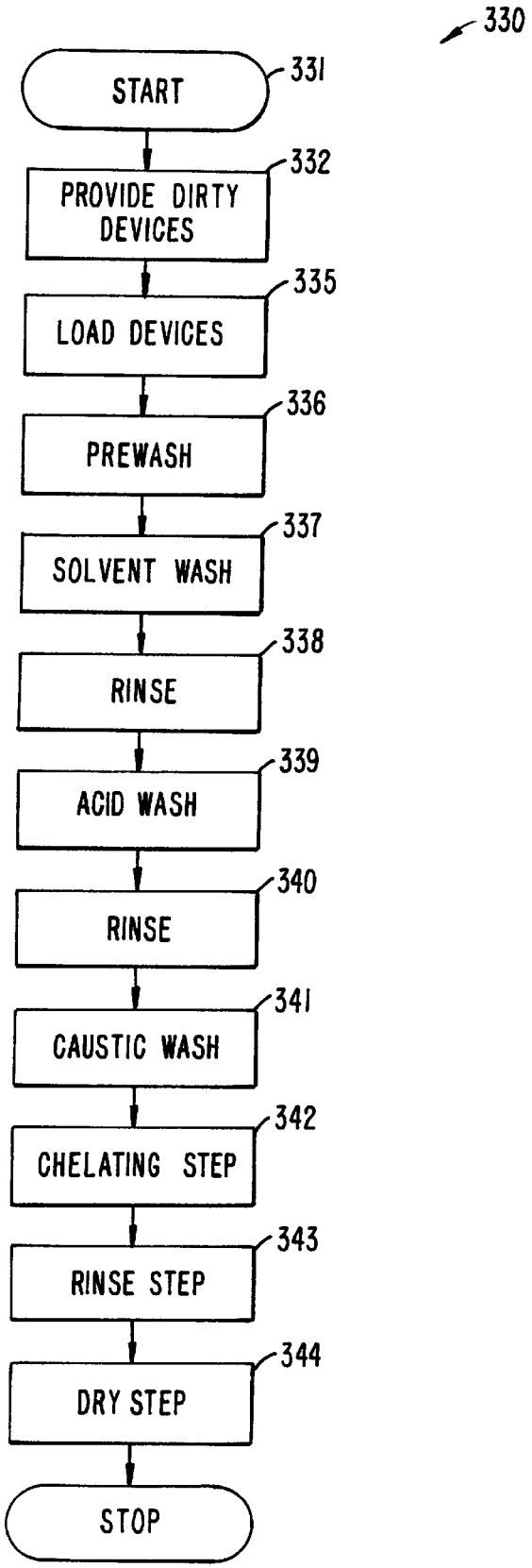

The above sequence of steps are used to substantially remove all particulate contamination and impurities from the porous polymeric devices. These devices are often "dirty" from the manufacturing process and should be substantially cleaned before use in a manufacturing operation, e.g., semiconductor fabrication. The above sequence of steps removes or substantially reduces quantities of ionic contamination and particulate. Although complex, the above sequence of steps is easily used in a washer unit with a programmable control unit. Depending upon the embodiment or embodiments, a rinse cycle or cycles may follow any of the above washes. Accordingly, the present method can be easily implemented using conventional technology in a cost effective manner. Details of the above method are illustrated by way of FIG. 3A, which illustrates a simplified flow diagram 330 of a cleaning method according to an embodiment of the present invention. This Fig. is merely an illustration and should not limit the scope of the claims herein. One of ordinary skill in the art would recognize other variations, modifications, and alternatives.

As merely an example, a process according to the present invention begins at step 331. The process has a step (step 332) of providing a plurality of porous polymeric devices, which require cleaning. These devices are generally from a manufacturer of polymeric devices or foam products. An example of this device is a product made by a company called Kanebo Limited of Japan. Other companies also have similar devices. These companies include, among others, Cupps Industrial Inc., Merocel Scientific Products, Perfect and Glory Enterprise Co., Ltd. In generally all of the present embodiments, the polymeric devices include a variety of impurities that can be detrimental to the manufacture of integrated circuits, for example. These impurities should be removed or reduced in concentration before use in a clean or sensitive environment.

The devices are loaded (step 335) into a washer/extraction unit which can be programmed with a variety of process recipes to clean and remove impurities from the devices. The unit can be any suitable washing machine-type unit with a variety of cleaning and rinsing cycles, which are programmable. As merely an example, the unit is a product made by a company called Dubix, but can be others. The unit is made of a suitable material to be chemically resistant and clean to reduce any possibility of particulate contamination or the introduction of impurities onto the devices to be cleaned. In preferred embodiments, the unit is a spin/rinse unit, which rotates a basket in a circular manner, to clean and remove impurities from the devices. The rotational action provides mechanical agitation to fluids that tend to loosen and remove impurities and particulate from the devices.

A program according to this embodiment is selected from the washer/extraction unit. The program is often loaded into controller such as a unit made by a company called Nova, as well as others. This program can carry out a variety of cleaning processes. This program removes a substantial amount of impurities and particulate contamination from the devices. The program can include a variety of process steps to selectively remove impurities from the product.

In a specific embodiment, the present method uses a step of performing a pre-wash (step 336) with clean water or ultra-clean deionized water. The pre-wash step removes loose particulate contamination from the product. The clean water also dissolves any water soluble contaminates from the product. The water has a resistivity of greater than 18 megohm about ninety percent (or greater) of the time with a 17.6 megohm minimum. Additionally, the pre-wash step is often maintained at room temperature or a temperature of less than about 60° C. The temperature is maintained at these temperature ranges to prevent any deformation of the product, which is often sensitive to high temperatures.

A solvent wash is performed (step 337) to the product. The solvent wash preferably introduces a relatively concentrated isopropyl alcohol (i.e., IPA) or any other solvent (e.g., reagent alcohol, ethyl alcohol) into the washer/extraction unit, which is often filled with clean water or other fluid. The solvent is suitable for dissolving any loose particulate contamination from the product. The loose particulate contamination can include any un-cross-linked polymers from the product. Additionally, the contamination can include any small and loose portions of the polymeric product. It is generally believed that the solvent dissolves portions of loose polymers from the product and washes them away. The IPA solvent is often maintained at a concentration of about 0.5% and less, but not lower than 0.05%, which reduces efficiency of the solvent wash process. A higher concentration than about 8%, however, may dissolve the product itself, which causes damage to such product. The solvent is preferably aqueous. In some embodiments, the solvent wash occurs in an agitation cycle of the washer/extraction unit. The agitation cycle is generally performed in a "gentle" mode, which reduces a possibility of excessive foaming. An aggressive cycle is generally not used since excessive foaming can occur in some embodiments.

A rinse step 338 can follow the solvent wash step. The rinse step generally removes any solvent along with any residual organic contaminants from the product. It occurs by draining the solvent from the product, filling the washer/extraction unit with clean water, agitating the product, draining the product, and using centrifugal force to extract residual liquid from the product. Of course, the exact sequence of steps depends upon the application. The rinse step is often maintained at a temperature of about 20° C. or less than about 60° C. to prevent any damage or deformation of the product. In a preferred embodiment, the rinse step occurs using "cold" water, which is either at about room temperature or slightly less than room temperature.

An acid wash (step 339) takes place to remove, for example, to remove any trace metals (e.g., iron, aluminum, copper) from the product. In particular, a liquid or gas including acid is introduced into the washer/extraction unit. In most embodiments, the acid is mixed with water for proper dilution. The acid wash can occur using a single or multiple steps. The acid wash is generally maintained at a concentration level between 0.3 and 0.6 weight ("wt")

percent. A concentration level below 0.04 wt percent will not maintain the target pH of less than two. A concentration above 2 wt percent may cause degradation of the product. The acid wash does not generally have any incidental limitations such as foaming or the like. Accordingly, it generally occurs using an aggressive or "high" wash cycle in some embodiments. The acid wash also occurs at a temperature of less than about 60° C. or about room temperature. Preferably, the acid can be any suitable compound such as hydrochloric acid (e.g., HCl), sulfuric acid, citric acid, and others. However, strong oxidizing acids, such as nitric acid, typically cannot be used because they may damage the product. The acid, however, is generally free from calcium and other elements, which may cause damage to, for example, and integrated circuit process or the like.

A rinse step 340 or steps follow each of all of the acid washes. The rinse step generally removes any acid and trace metals from the product. It occurs by draining the acid from the product, filling the washer/extraction unit with clean water, agitating the product, draining the product, and using centrifugal force to extract residual liquid from the product. Of course, the exact sequence of steps depends upon the application. The rinse step is often maintained at a temperature of about 20° C. or less than about 60° C. to prevent any damage or deformation of the product. In a preferred embodiment, the rinse step occurs using "cold" water, which is either at about room temperature or slightly less than room temperature.

A sequence of caustic washes (step 341) follows the acid wash according to an embodiment of the present invention. In a multi-step caustic wash method, a first caustic wash occurs to the product using a solution containing ammonium hydroxide. The ammonium hydroxide is at a concentration ranging from about 0.05% to about 5.0%, but can also be at other concentrations. High concentrations, however, are generally not desirable due to noxious fumes and the like. Extremely low concentrations generally reduce the effectiveness of the washing step. The caustic washing step removes a portion of negative ions or particles with a negative zeta potential from the product according to some embodiments. Negative ions are also removed from the product by way of a concentration gradient according to some embodiments. The caustic wash step is maintained at a temperature of about 15° C.–20° C. and less than about 60° C. to prevent any damage to the product, which is temperature sensitive. The caustic wash step also can occur using a gentle cycle or an aggressive cycle, depending upon the application. In some embodiments, the caustic wash step does not allow for any introduction of a sodium bearing compound such as sodium hydroxide or a potassium bearing compound such as potassium hydroxide. These compounds are generally detrimental to electronic devices such as integrated circuits, hard disks, and the like.

A chelating step (step 342) occurs to remove additional trace metals from the product. The chelating step uses a compound such as EDTA to remove trace metals from a caustic solution from the first caustic wash. The chelating step "grabs" trace metals from the basic solution. By way of the basic solution, these metals do not precipitate out. The second caustic wash, which is noted above, removes or "scavenges" any remaining impurities such as calcium, magnesium, and others. In a preferred embodiment, the EDTA solution concentration ranges from about 5 ppm to about 500 ppm, but can be others. Additionally, the solution temperature ranges from about 17° C. to about 40° C. and is less than about 60° C. to prevent a possibility of damage to the product.

A rinse step 343 can follow the caustic wash step. The rinse step generally removes any caustic with impurities from the product. It occurs by draining the caustic solution from the product, filling the washer/extraction unit with clean water, agitating the product, draining the product, and using centrifugal force to extract residual liquid from the product. Of course, the exact sequence of steps depends upon the application. The rinse step is often maintained at a temperature of about 20° C. or less than about 60° C. to prevent any damage or deformation of the product. In a preferred embodiment, the rinse step occurs using "cold" water, which is either at about room temperature or slightly less than room temperature.

The method performs a step of drying or removing a substantial portion of moisture (step 344) from the product. In a specific embodiment, the method uses a step of mechanical "spinning" to accelerate the product to high speeds, which are often desirable to remove moisture from the product. In particular, the rinse water is drained from the product, the washer/extraction unit is spun, and moisture is thereby removed from the product. After the process, the devices are substantially free from impurities. As merely an example the impurities would be less than those noted in Table 1, but can be others depending upon the application and needs. The cleaned or microcleaned devices are removed (step 341) from the washer/extraction unit in a clean room environment before packaging. The clean room environment is generally at least a Class 100 or Class 10 clean room, which prevents additional contamination from attaching onto the devices.

The process stops at step 343, but additional steps can be performed as desired.

The above process is merely an example of a technique that can be performed to provide ultra clean surface treatment devices according to an embodiment of the present invention. The present invention can also be performed in a "batch" type process, where various cleaning solutions are applied to the devices in a sequential manner. This batch type process would include immersion of the devices in tanks, sprays, and other techniques. Additionally, the sequence of steps is not intended to be limiting. It will be recognized that the steps can be performed in another order without departing from the scope of the claims herein. Furthermore, a step or steps can be removed, a step or steps can be combined or even added in some embodiments.

Although the above techniques have been generally described in terms of system hardware and software, it would be recognized that other variations can exist. As merely an example, the present invention can be implemented by combining further aspects in hardware. Alternatively, the present invention can be implemented by combining further aspects in software. The hardware can be integrated more fully or even separated. Alternatively, the software can be integrated more fully or even separated. Depending upon the application, the present invention uses hardware, software, or a combination of both hardware and software to carry out elements as recited by the claims herein.

Figure 4:
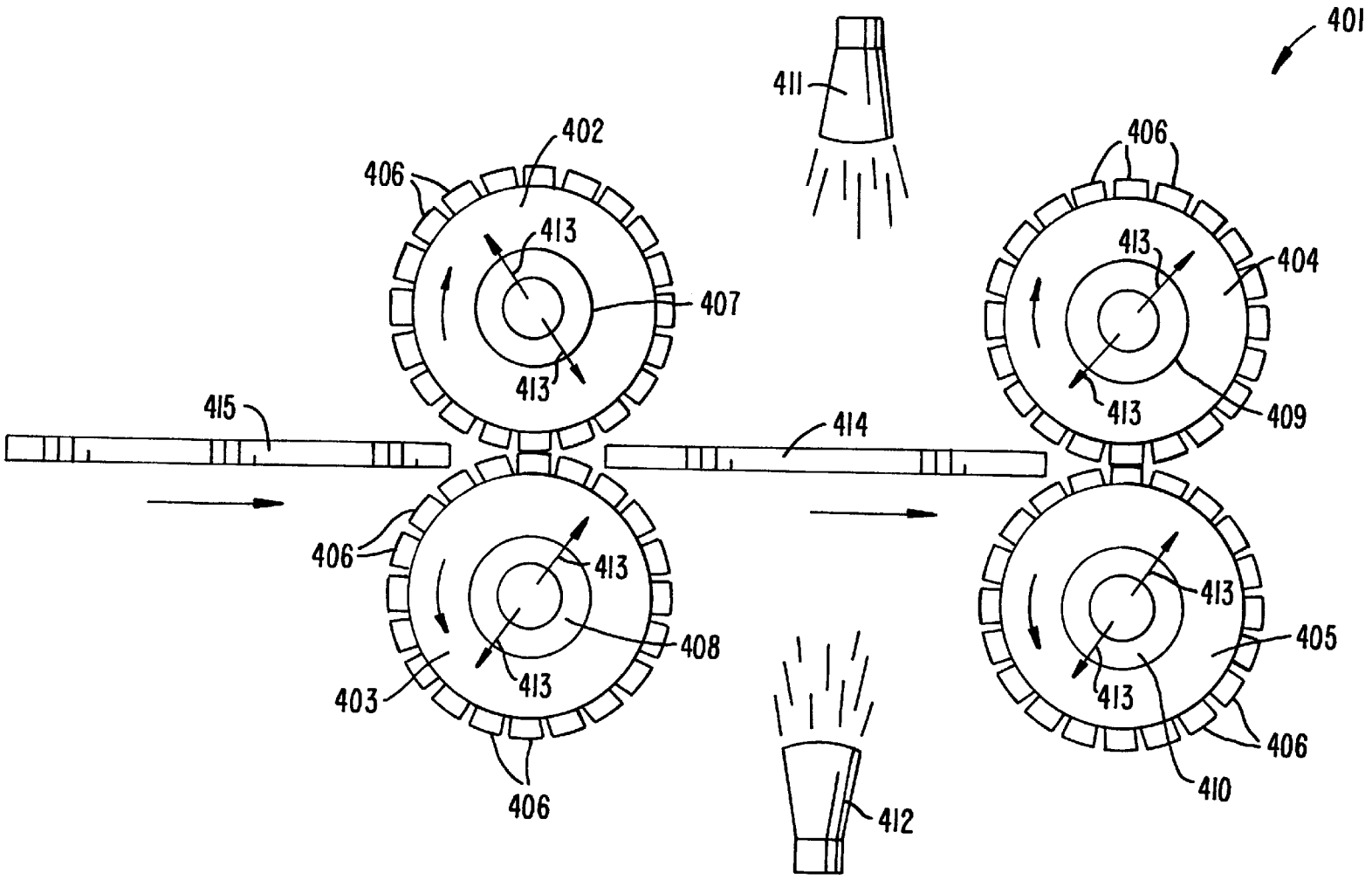
FIG. 4 is a simplified diagram of a scrubbing process according to an embodiment of the present invention.

FIG. 4 is a simplified diagram of a scrubbing process according to an embodiment of the present invention. This Fig. is merely an illustration and should not limit the scope of the claims herein. One of ordinary skill in the art would recognize other variations, modifications, and alternatives. The scrubbing process uses the cleaned devices according to the present invention. As shown in the Fig., a semiconductor product wafer cleaning system 401 has two brush stations, a first comprising cylindrical PVA brushes 402 and 403, and a second comprising cylindrical PVA brushes 404 and 405. On each of the brushes, there are projections 406 also made of PVA. The brushes are mounted on spindles 407, 408, 409 and 410 so that they are barely touching and rotate in the direction indicated. Deionized water and, if used, any cleaning chemistries are sprayed from nozzles 411 and 412 and pumped 413 through the brushes from the spindles. The combination of the water and brush contact acts to remove residual cleaning composition from a semiconductor product wafer 414 which is passed through the brushes in the cleaning stations.

In order to remove the slurry or other residue, deionized water is pumped through holes in the spindle to saturate the tubular brushes. Additionally, deionized water sprayed from nozzles above and below impinges the wafers. As the brushes rotate over the surface of the wafer, they tend to pick up and trap in the brush surface particles of the slurry and other residue of the cleaning composition. The slurries which eventually contaminate the cleaning brushes and render them ineffective for further cleaning comprise the slurries and other cleaning compositions described in the background section of this application.

The cleaning brushes used in post CMP cleaning operations is employed in connection with resilient foam brushes such as those used on the Synergy wafer cleaning system manufactured by OnTrak Systems, Inc. of Milpitas, Calif. This system employs multiple sequential cleaning stations wherein each station comprises a pair of tubular brushes made of polyvinyl alcohol (PVA) in the form of a foam. Each brush has a length of approximately 10 in. (25.4 cm), an outside diameter of approximately 2⅜ in. (6.0 cm) and an inside diameter of approximately 1¼ in. (3.2 cm), and has an outer cylindrical surface covered with foam projections approximately 3/16 in. (0.5 cm) in height and A in. (0.7 cm) in diameter. Each brush is rotatably mounted on a spindle through which may be pumped water to saturate the brush and the brushes at each station are spaced so that the surfaces approximately contact each other. Given the resilience of the foam, this permits thin semiconductor wafers containing the cleaning composition residue to pass between the pairs of brushes as they rotate. Typically, as the cleaning system will have two (2) stations, with each station having a pair of the brushes as described above. The wafers pass directly from one station through the other.

The semiconductor product wafers which may be cleaned by the system referenced herein include silicon, silicon nitride, silicon oxide, polysilicon or various metals and alloys. As used herein the term "product wafer" refers to the wafer which is to be intended to be produced in a final semiconductor device by further treatment. The CMP compositions which are used to planarize or otherwise treat and polish the surface of the semiconductor product wafers must be removed to a sufficient degree so that subsequent manufacture and deposition steps may be made to a clean surface.

The above process and apparatus are merely illustrations of the present invention. It will be recognized that other modifications, variations, and alternatives can exist.

Experimental

To prove the operation and principle of the present invention, experiments have been performed. In these experiments, a system according to the present invention was made and used to show superior cleaning of sponge or porous polymeric products. The system used was a washer/extraction unit made by Dubix. A plurality of dirty sponge products were introduced into the system. As merely an example, the information in Table 1A and 1B show conventional impurity concentrations in a polymeric sponge product made by Kanebo Limited, but is not limited to this vendor. The sponge products were received in lengths of about 350 mm. They were cut to form a plurality of sponge products, each having a length of about 250 mm and less. These sponge products were loaded into the washer/extraction unit made by Dubix. A recipe was programmed into the washer/extraction unit by way of a computer software interface. The interface was provided by a company called Nova Systems, but is not limited to this vendor. As merely an example, the washer/extraction unit was programmed using the recipe in Table 2. As shown, the Table lists a sequential order of steps (e.g., 1, 2, 3); operation (e.g. rinse, wash); process times (in minutes and seconds); general information (e.g., gentle wash cycle, normal wash cycle); water temperature (e.g., cold, hot); liquid level (in percentages); solution type (e.g., water, alcohol); and solenoid times.

PROCESS RECIPE

| | | Time | | | Function | | | |
|---|---|---|---|---|---|---|---|---|
| Step | Operation | mn | s | Info | Water | Level | Solution | Product |
| 1 | Prewash 1 | 2 | 0 | Form 2 | Cold | 100 | DI water | 1.8 sec. |
| 2 | Drain 1 | 1 | 30 | Normal | | | | |
| 3 | Extract 1 | | 40 | 30L, 10H | | | | |
| 4 | Wash 1 | 3 | 0 | | Cold | 100 | 0.5% IPA | 3,4 s. |
| 5 | Drain 2 | 1 | 40 | Gentle | | | | |
| 6 | Rinse 1 | 2 | 0 | | CoId | 100 | | |
| 7 | Drain 3 | 2 | 30 | Normal | | | | |
| 8 | Extract 2 | | 50 | 40L, 10H | | | | |
| 9 | Wash 2 | 3 | 0 | | Cold | 100 | 0.30% HCL | 2, HCL |
| 10 | Drain 4 | 1 | 10 | | | | | |
| 11 | Wash 3 | 4 | 0 | | Cold | 100 | 0.60% HCL | 2, HCL |
| 12 | Drain 5 | 1 | 20 | | | | | |
| 13 | Extract 3 | | 40 | 30L, 10H | | | | |
| 14 | Rinse 2 | 2 | 0 | | Cold | 100 | | |
| 15 | Drain 6 | 1 | 30 | | | | | |
| 16 | Extract 4 | | 40 | 30L, 10H | | | | |
| 17 | Rinse 3 | 2 | 0 | | Cold | 100 | | |
| 18 | Drain 7 | 1 | 10 | | | | | |
| 19 | Wash 4 | | 10 | | Cold | 60 | 0.08% $NH_4OH$ | 4,4 s |

-continued

PROCESS RECIPE

| | | Time | | | Function | | | |
|---|---|---|---|---|---|---|---|---|
| Step | Operation | mn | s | Info | Water | Level | Solution | Product |
| 20 | Wash 5 | 4 | 0 | | Cold | 100 | 50 ppm EDTA | 5,4 s |
| 21 | Drain 8 | 1 | 30 | | | | | |
| 22 | Extract 5 | | 40 | 30L, 10H | | | | |
| 23 | Wash 6 | 3 | 0 | | Cold | 100 | 0.5% $NH_4OH$ | 4,4 s |
| 24 | Drain 9 | 1 | 30 | | | | | |
| 25 | Extract 6 | | 40 | 30L, 10H | | | | |
| 26 | Rinse 4 | | 40 | | Cold | 70 | | |
| 27 | Drain 10 | 1 | 40 | Normal | | | | |
| 28 | Rinse 5 | 2 | 0 | | Cold | 100 | | |
| 29 | Drain 11 | 1 | 30 | Dist. | | | | |
| 30 | Extract 7 | | 40 | 30L, 10H | | | | |
| 31 | Rinse 6 | 2 | 0 | | Cold | 100 | 0.25% $NH_4OH$ | 4,4 s |
| 32 | Drain 12 | 1 | 20 | | | | | |
| 33 | Extract 8 | | 40 | 30L, 10H | | | | |

Table 2: Recipe for Washer/Extraction Unit

The above recipe uses a series of steps including washes and rinses. The combination of these steps provided an ultra-clean sponge product. The sponge produced had an impurity concentration level that was superior to conventional sponge product devices. As merely an example, Table 1A lists some of the impurity concentrations in the present sponge devices.

Although the above embodiments are generally described in terms of semiconductor manufacturing, the invention has a much broader range of applicability. For example, the invention can be applied to a manufacturing process for wafers, hard disks, flat panel displays, and other devices that require a high degree of cleanliness. Additionally, the present invention can be used to replenish or rework "dirty" foam products. Accordingly, the present invention is not limited to cleaning products before being introduced into a manufacturing process.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. An out of the box ultraclean brush, said ultraclean brush device comprising:

an elongated porous polymeric member comprising an outer surface for removing residual particles from a surface of a substrate;

wherein said elongated porous member comprises a polyvinyl alcohol bearing compound, said elongated porous member having a calcium ion impurity concentration of less than about 0.05 part per million, and said elongated porous member having a sodium impurity concentration of less than about 0.10 part per million, and said elongated porous member having a sulfate impurity concentration of less than about 0.20 part per million;

wherein said elongated porous member being substantially free from any loose portions of said porous polymeric member greater than about 0.5 micron in size.

2. The brush device of claim 1 wherein said outer surface includes a plurality of protrusions, said plurality of protrusions providing a surface for mechanically removing residual particles from said surface of said substrate.

3. The brush device of claim 1 wherein said elongated porous polymeric member is selected from a material including polyvinyl acetal porous elastic material.

4. The brush device of claim 1 wherein said elongated porous polymeric member comprises an inner orifice that extends along a center region of said elongated porous polymeric member.

5. The device of claim 1 wherein said porous polymeric member having a fluorine impurity concentration of less than about 1 part per million.

6. The device of claim 1 wherein said porous polymeric member having a nitrite ion impurity concentration of less than about 0.01 part per million.

7. The device of claim 1 wherein said porous polymeric member having a lithium impurity concentration of less than about 0.1 part per million.

8. The device of claim 1 wherein said porous polymeric member having a phosphate impurity concentration of less than about 0.05 part per million.

9. The device of claim 1 wherein said porous polymeric member having a nitrate impurity concentration of less than about 0.05 part per million.

10. The device of claim 1 wherein said porous polymeric member having a bromide impurity concentration of less than about 0.05 part per million.

11. The device of claim 1 wherein said porous polymeric member having a magnesium impurity concentration of less than about 0.01 part per million.

12. The device of claim 1 wherein said porous polymeric member having a potassium impurity concentration of less than about 0.05 part per million.

13. An out of the box surface treatment device, said device comprising:

a porous polymeric member comprising an outer surface for removing residual particles from a surface of a substrate;

wherein said porous polymeric member comprises a polyvinyl alcohol bearing compound, said porous polymeric member having a calcium ion impurity concentration of less than about 0.05 part per million, said porous polymeric member having a sodium concentration of less than about 0.1 part per million, and said porous member having a sulfate impurity concentration of less than about 0.20 part per million, said porous polymeric member being substantially free from loose portions of said porous polymeric member greater than about 0.5 micron in size.

14. The device of claim 13 wherein said outer surface includes a plurality of protrusions, said plurality of protrusions providing a surface for mechanically removing residual particles from said surface of said substrate.

15. The device of claim 13 wherein said porous polymeric member is selected from a material including polyvinyl acetal porous elastic material.

16. The device of claim 13 wherein said porous polymeric member comprises an inner orifice that extends along a center region of said porous polymeric member.

17. The device of claim 13 wherein said porous polymeric member having a fluorine impurity concentration of less about 1 part per million.

18. The device of claim 13 wherein said porous polymeric member having a nitrite ion impurity concentration of less than about 0.01 part per million.

19. The device of claim 13 wherein said porous polymeric member having a lithium impurity concentration of less than about 0.1 part per million.

20. The device of claim 13 wherein said porous polymeric member having a phosphate impurity concentration of less than about 0.05 part per million.

* * * * *